US006234210B1

(12) United States Patent
Millas

(10) Patent No.: US 6,234,210 B1
(45) Date of Patent: May 22, 2001

(54) ELLIPTICAL HEAT PIPE WITH CARBON STEEL FINS AND BONDED WITH ZINC GALVANIZING

(75) Inventor: George S. Millas, Houston, TX (US)

(73) Assignee: Hudson Products Corporation, Houston, TX (US)

( * ) Notice: Subject to any disclaimer, the term of this patent is extended or adjusted under 35 U.S.C. 154(b) by 0 days.

(21) Appl. No.: 09/245,518

(22) Filed: Feb. 5, 1999

(51) Int. Cl.[7] ..... F15D 55/00
(52) U.S. Cl. ..... 138/38
(58) Field of Search ..... 138/38; 165/182, 165/178, 183

(56) References Cited

U.S. PATENT DOCUMENTS 3,373,803 * 3/1968 Steinberg et al. ..... 165/182
3,865,184 * 2/1975 Grover ..... 138/38
4,830,100 * 5/1989 Kato et al. ..... 165/104.14
4,875,522 * 10/1989 Noda et al. ..... 165/104.14
4,960,170 * 10/1990 Carter ..... 165/182
5,029,389 * 7/1991 Tanzer ..... 29/890.32
5,186,251 * 2/1993 Joshi ..... 165/183
5,467,816 * 11/1995 Larinoff ..... 165/182
5,743,014 * 4/1998 Giammaruti et al. ..... 29/890.032

* cited by examiner

*Primary Examiner*—David A. Scherbel
*Assistant Examiner*—Davis Hwu
(74) *Attorney, Agent, or Firm*—R. J. Edwards; E. Marich; R. C. Baraona

(57) ABSTRACT

A heat pipe has an elliptical cross-section. Heat exchange fins are mounted to the heat pipe at the condenser end. The fins are galvanized on the heat pipe. Spacer pins can be used to support and space the heat exchange fins from each other. Internal spacers can be provided within the heat pipe to add support to the heat pipe structure for longer heat pipes.

2 Claims, 1 Drawing Sheet

ELLIPTICAL HEAT PIPE WITH CARBON STEEL FINS AND BONDED WITH ZINC GALVANIZING

FIELD AND BACKGROUND OF THE INVENTION

The present invention relates generally to the field of heat exchange in industrial processes and in particular to a new and useful heat pipe structure.

Heat pipes are known in the field of heat exchange. Heat pipes are conventionally cylindrical, with circular cross-sections. Caps are provided at each end to form a closed vessel. A wick is provided through the center of the pipe. A working fluid is provided inside the heat pipe vessel.

One end of the pipe is an evaporator end and is exposed to a warm substance, such as hot air. The other end is a condenser end and is exposed to a cooler substance. The heat at the evaporator end causes the working fluid to evaporate and travel to the opposite end of the heat pipe, to the condenser end. At the condenser end, the working fluid gives up the heat to the heat pipe material, exchanging heat with the cooler substance, and condenses to a fluid, which is then wicked back to the evaporator end to repeat the cycle. When the working fluid is selected properly, heat can be efficiently transferred in this manner between substances having a relatively small temperature difference, as well as those with larger temperature differences.

Non-circular tubes are known for use in heat exchangers. Heat exchanger tubes are distinct from heat pipes, however, as they lack the internal structure of a heat pipe and cannot be used as a self-contained heat exchange system. In particular, past designs are not well adapted to including a wick, which is an essential element of a heat pipe, and required for it to function.

For example, U.S. Pat. No. 5,279,692 discloses an elliptical tube having several discrete, generally triangular cross-section flow passages through the tube.

Non-circular cross-section tubes used in boilers and furnaces having cross-sectional stiffeners are known. U.S. Pat. No. 5,511,613 discloses a non-circular cross-section tube used in a boiler heat exchanger. The tube may have cross-sectional stiffeners inside the tube. The stiffeners are different shapes and form restrictive barriers inside the tubes.

Elliptical-shaped pipes in particular have properties which are beneficial for use as heat pipe vessels. A larger surface area is provided for condensation to occur on. The narrowed width concentrates and minimizes the amount of working fluid in liquid form in the evaporator end of the heat pipe.

SUMMARY OF THE INVENTION

It is an object of the present invention to provide a heat pipe having a non-circular cross-section to take advantage of the different cross-section.

Accordingly, a heat pipe is provided having an elliptical cross-section. Heat exchange fins are mounted to the heat pipe at the condenser end. The fins are galvanized on the heat pipe. Spacer pins can be used to support and space the heat exchange fins from each other. Internal spacers can be provided within the heat pipe to add support to the heat pipe structure for longer heat pipes.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
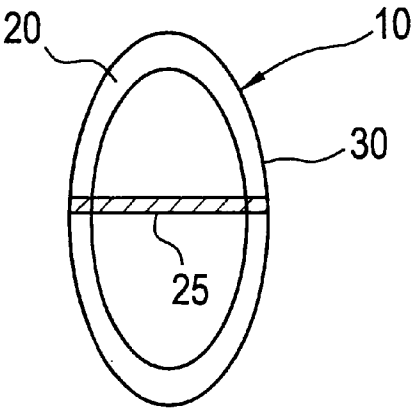
FIG. 1 is a cross-sectional end elevation view of a heat pipe of the invention.

Referring now to the drawings, in which like reference numerals are used to refer to the same or similar elements, FIG. 1 shows the elliptical cross-section of a heat pipe 10 of the invention. The heat pipe 10 has a vessel body 30 which is non-circular in cross-section. An internal support 25 may be placed within the vessel body 30 to lend support to the vessel body 30, such as when the heat pipe 10 is elongated. The support 25 may be a planar segment extending between two of the inside walls of the vessel body 30.

The interior of the heat pipe 10 also includes a wick 20 around the interior wall of the vessel body 30 which conveys a working fluid (not shown) between the condenser and evaporator ends of the heat pipe.

The working fluid is heated and evaporates at the evaporator end and flows through the center of the vessel body 30 to the condenser end, where the cooler substance outside the heat pipe 10 causes the working fluid to condense. The working fluid is absorbed by the wick 20 and moves back toward the evaporator end by wicking action.

The elliptical cross-section of the vessel body 30 provides a larger heat exchange surface area for the heat pipe 10. Further, the working fluid is concentrated and minimized in the evaporator end of the heat pipe 10. These improvements increase the efficiency of the heat pipe 10 in transferring heat between the substances at each end.

Figure 2:
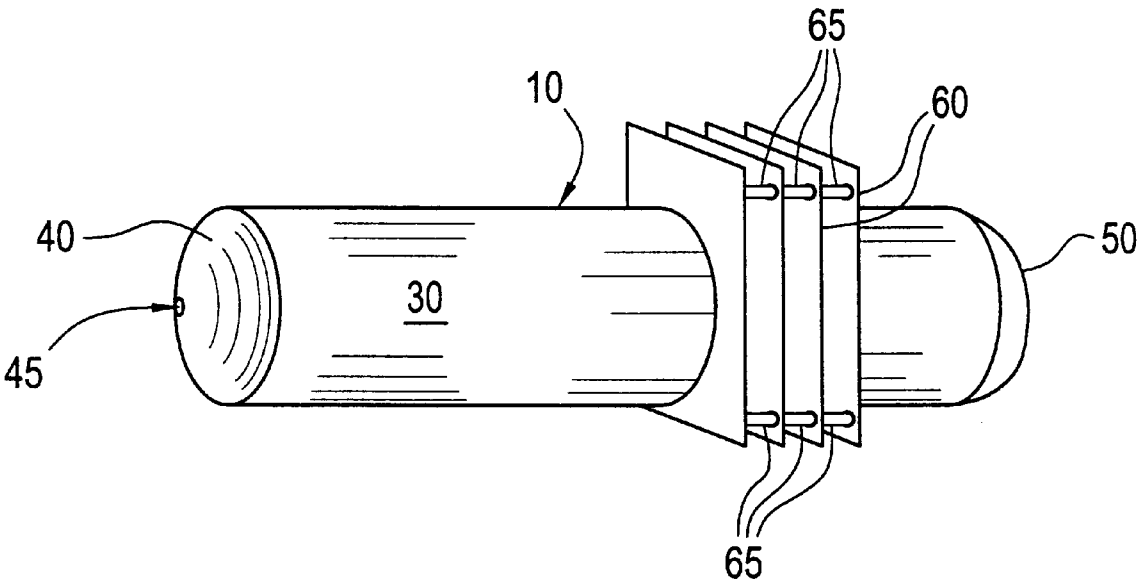
FIG. 2 is a right side, end perspective view of a heat pipe of the invention.

FIG. 2 displays the entire heat pipe 10, with evaporator end cap 40, condenser end cap 50 and heat exchange fins 60. The heat exchange fins 60 may have fin spacers 65 adjacent each corner to support and space the heat exchange fins 60 apart from each other. The heat exchange fins 60 are preferably made of carbon steel, so that they may be bonded to the surface of the heat pipe vessel body 30 by galvanizing. Thus, the vessel body 30 is also preferably made of steel, such as carbon steel. The heat exchange fins 60 improve the heat exchange properties of the heat pipe 10 by extending, or increasing, the heat exchange surface area.

A vent or valve 45 is located on the evaporator end cap 40. The valve 45 is used to fill the heat pipe with a working fluid. Although it is shown on the evaporator end cap 40, the valve 45 may be positioned at either end cap 40, 50.

The end caps 40, 50 are preferably made of carbon steel and welded to the vessel body 30 to form an air-tight seal.

While a specific embodiment of the invention has been shown and described in detail to illustrate the application of the principles of the invention, it will be understood that the invention may be embodied otherwise without departing from such principles.

What is claimed is:

1. A heat pipe having improved heat transfer efficiency, comprising:

a vessel body having a non-circular and continuously curved cross-section;

a pair of end caps at each end of the vessel body sealing the ends thereof;

wick means inside the vessel body for conveying a condensed working fluid from one end of the vessel body to the other end;

filling means through one of the end caps for inserting the working fluid into the vessel body;

a plurality of rectangular heat exchange fins surrounding the vessel body oriented perpendicular to a longitudinal axis of the vessel body; and a plurality of spacer pins adjacent each corner of the heat exchange fins between each pair of adjacent heat exchange fins for supporting and spacing the plurality of rectangular heat exchange fins.

2. A heat pipe having improved heat transfer efficiency, comprising:

a vessel body having a non-circular and continuously curved cross-section;

a pair of end caps at each end of the vessel body sealing the ends thereof;

wick means inside the vessel body for conveying a condensed working fluid from one end of the vessel body to the other end;

filling means through one of the end caps for inserting the working fluid into the vessel body; and a planar support extending between opposite sides of the vessel body for supporting the sides of the vessel body.

* * * * *